US011798407B1

(12) United States Patent
Wang et al.

(10) Patent No.: US 11,798,407 B1
(45) Date of Patent: Oct. 24, 2023

(54) METHOD AND SYSTEM FOR IDENTIFYING LANE CHANGING INTENTION OF MANUALLY DRIVEN VEHICLE

(71) Applicant: SOOCHOW UNIVERSITY, Suzhou (CN)

(72) Inventors: Xiang Wang, Suzhou (CN); Zhangji Ling, Suzhou (CN); Shufan Han, Suzhou (CN); Yuyao Zan, Suzhou (CN); Beibei Xu, Suzhou (CN); Jiayi Song, Suzhou (CN); Fangyu Feng, Suzhou (CN); Zichun Peng, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 0 days.

(21) Appl. No.: 18/036,883

(22) PCT Filed: Oct. 31, 2022

(86) PCT No.: PCT/CN2022/128587

§ 371 (c)(1),
(2) Date: May 14, 2023

(30) Foreign Application Priority Data

Aug. 3, 2022 (CN) ..... 202210924589.9

(51) Int. Cl.
*G08G 1/01* (2006.01)
*G08G 1/017* (2006.01)
(Continued)

(52) U.S. Cl.
CPC ..... *G08G 1/0133* (2013.01); *G07C 5/02* (2013.01); *G08G 1/017* (2013.01); *G08G 1/052* (2013.01)

(58) Field of Classification Search
CPC ..... G08G 1/0133; G08G 1/017; G08G 1/052; G07C 5/02
See application file for complete search history.

(56) References Cited

U.S. PATENT DOCUMENTS

2010/0253598 A1* 10/2010 Szczerba ..... G06V 10/806 701/532
2019/0061780 A1* 2/2019 Han ..... G05D 1/0061
(Continued)

FOREIGN PATENT DOCUMENTS

CN 109460023 A 3/2019
CN 110569783 A 12/2019
(Continued)

*Primary Examiner* — Behrang Badii
(74) *Attorney, Agent, or Firm* — SZDC LAW P.C.

(57) ABSTRACT

A method and system for identifying a lane changing intention of a manually driven vehicle are disclosed. The method includes: preprocessing a preset vehicle trajectory data set; extracting vehicle traveling features and driving behavior features of a target vehicle; constructing a vehicle following and lane changing decision prediction model based on machine learning, and inputting the preprocessed vehicle trajectory data set into the prediction model for training; obtaining a speed, an acceleration and a vehicle head distance of the target vehicle according to the vehicle traveling features of the target vehicle, and obtaining a large vehicle feature value and a clustering feature value according to the driving behavior features of the target vehicle; and inputting the speed, the acceleration, the vehicle head distance, the large vehicle feature value and the clustering feature value into the trained prediction model to obtain a lane changing intention identification result of the target vehicle.

7 Claims, 9 Drawing Sheets

(51) Int. Cl.
*G08G 1/052* (2006.01)
*G07C 5/02* (2006.01)

(56) References Cited

U.S. PATENT DOCUMENTS

| | | | | |
|---|---|---|---|---|
| 2019/0077404 | A1* | 3/2019 | Takeda | B60W 10/04 |
| 2021/0053569 | A1* | 2/2021 | Censi | G08G 1/0112 |
| 2022/0306113 | A1* | 9/2022 | Raffone | B60W 60/0011 |

FOREIGN PATENT DOCUMENTS

| | | | |
|---|---|---|---|
| CN | 111114556 | A | 5/2022 |
| CN | 115018016 | A | 9/2022 |
| EP | 3124349 | | 2/2017 |

* cited by examiner example: data unit unification

| | NGSIM | HighD |
|---|---|---|
| standard time | 0.01s<br>↓<br>0.1s | S<br>↓<br>0.1s |
| parallel/perpendicular road direction position | Ft<br>↓<br>m | m |
| speed | ft/s<br>↓<br>m/s | m/s |
| acceleration | $ft/s^2$<br>↓<br>$m/s^2$ | $m/s^2$ |
| vehicle length and vehicle width | ft<br>↓<br>m | m |

Fig. 4 data example

| Vehicle_ID | Frame_ID | v_Class | v_Vel | v_Acc | Lane_ID | Preceding | Following | Space_Headway | Time_Headway | Location |
|---|---|---|---|---|---|---|---|---|---|---|
| 815 | 2330 | 2 | 23.31 | 2.05 | 3 | 800 | 823 | 119.1 | 5.11 | us-101 |
| 815 | 2330 | 2 | 23.31 | 2.05 | 3 | 800 | 823 | 119.1 | 5.11 | us-101 |
| 2224 | 6548 | 2 | 28.54 | -0.78 | 4 | 2208 | 2211 | 53.34 | 2.01 | i-80 |
| 2127 | 6459 | 2 | 37.82 | 11.2 | 2 | 2124 | 2132 | 42.97 | 1.3 | us-101 |
| 1033 | 4857 | 2 | 41.99 | 0.1 | 1 | 1029 | 1040 | 38.81 | 0.92 | us-101 |
| 1033 | 4857 | 2 | 41.99 | 0.1 | 1 | 1029 | 1040 | 38.81 | 0.92 | us-101 |
| 1980 | 9157 | 3 | 45.12 | -0.55 | 5 | 1982 | 1997 | 102.65 | 2.27 | us-101 |
| 744 | 3392 | 2 | 24.54 | -0.04 | 3 | 740 | 732 | 37.8 | 1.54 | us-101 |
| 744 | 3392 | 2 | 24.54 | -0.04 | 3 | 740 | 732 | 37.8 | 1.54 | us-101 |
| 879 | 6238 | 2 | 0 | 0 | 1 | 869 | 881 | 22.95 | 9999.99 | lankershim |
| 2253 | 6902 | 2 | 6.57 | 3.93 | 5 | 2239 | 2244 | 46.38 | 7.06 | i-80 |
| 1503 | 8639 | 2 | 47.47 | 5.98 | 1 | 1502 | 1509 | 46.1 | 0.97 | lankershim |
| 2232 | 6384 | 2 | 7.33 | 0 | 3 | 2117 | 2266 | 35.98 | 4.91 | i-80 |
| 2308 | 7958 | 2 | 25.78 | 7.44 | 6 | 2301 | 2304 | 39.17 | 1.52 | i-80 |
| 1919 | 8238 | 2 | 4.79 | 0.3 | 4 | 1919 | 1923 | 25.03 | 5.23 | i-80 |
| 496 | 2766 | 2 | 22.39 | -6.93 | 3 | 510 | 502 | 66.21 | 2.09 | us-101 |
| 496 | 2766 | 2 | 22.39 | -6.93 | 3 | 510 | 502 | 68.21 | 2.09 | us-101 |
| 948 | 4194 | 2 | 22.67 | 0 | 1 | 938 | 951 | 69.94 | 2.69 | us-101 |
| 948 | 4194 | 2 | 22.67 | 0 | 1 | 938 | 951 | 69.94 | 2.69 | us-101 |
| 653 | 3318 | 2 | 31.9 | 0 | 1 | 0 | 0 | 0 | 0 | lankershim |
| 1779 | 5317 | 3 | 49.92 | 1.69 | 3 | 1769 | 1784 | 158.54 | 3.2 | us-101 |
| 2780 | 8340 | 2 | 0 | 0 | 2 | 2768 | 2782 | 24 | 9999.99 | us-101 |
| 1528 | 6886 | 2 | 43.39 | 0 | 1 | 0 | 1541 | 0 | 0 | lankershim |
| 1212 | 6653 | 2 | 30.03 | 0.24 | 2 | 0 | 1218 | 0 | 0 | us-101 |
| 1330 | 16267 | 2 | 0 | 0 | 12 | 1338 | 1333 | 28.07 | 9999.99 | lankershim |

radar chart of cluster analysis

| class | behavior feature | driving type |
|---|---|---|
| class1 | lane changing frequency is prominent | "effective and rush" type traveling |
| class2 | traveling speed is high<br>vehicle head distance is small | "efficient and experienced" type traveling |
| class3 | vehicle head time interval is large<br>speed change is rapid | "safe and careful" type traveling |
| class4 | features are not prominent | "safe and robust" type traveling |

driving type analysis

Fig. 7

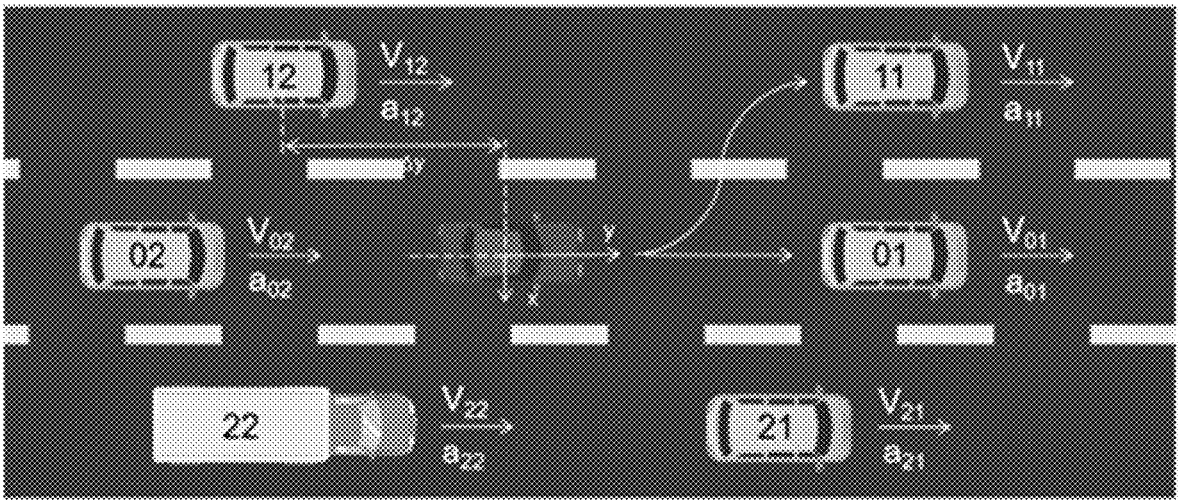

Fig.8

METHOD AND SYSTEM FOR IDENTIFYING LANE CHANGING INTENTION OF MANUALLY DRIVEN VEHICLE

This application is the National Stage Application of PCT/CN2022/128587, filed on Oct. 31, 2022, which claims priority to Chinese Patent Application No. 202210924589.9, filed on Aug. 3, 2022, which is incorporated by reference for all purposes as if fully set forth herein.

FIELD OF THE DISCLOSURE

The present application relates to the field of vehicle lane changing prediction technologies, and particularly to a method and system for identifying a lane changing intention of a manually driven vehicle in an expressway moving bottleneck environment.

BACKGROUND OF THE DISCLOSURE

Vehicle intention identification means that whether a driver decides to follow or change a lane is judged by analyzing vehicle trajectory data, a driver behavior, a surrounding environment, or the like. Due to uncertainty of a person, a vehicle and the environment, identification of a lane changing intention of a manually driven vehicle often has certain complexity. In order to effectively identify the lane changing intention of the vehicle, various model methods are researched currently: a rule model (a lane changing process is summarized as a decision tree with a series of fixed conditions, a binary selection result is output finally, the model is flexible, but individual driver behaviors are not considered), a discrete selection model (it is assumed that a lane changing operation is only performed when there exists an acceptable gap and the model does not conform to a severe congestion situation), a Markov model (it is assumed that a lane changing time is constant under stable traffic conditions, a core idea is a series of states which change over time, and each current state is only related to a few finite previous states), a survival model (for a problem of insufficient consideration of randomness and probability of unsafe characteristics in a cognitive process (perception, judgment and execution) of a following vehicle driver in models), or the like; meanwhile, a physiological-psychological model, a cellular automaton model, and other lane changing prediction or decision methods are also available.

With a continuous development and improvement of an expressway traffic system, a mass of vehicle trajectory data sets can be used for perceiving the lane changing intention of the manually driven vehicle. Identification of the lane changing intention of the vehicle mainly includes processing, comparison, analysis, or the like, of trajectories using machining learning, and the commonly used traditional model cannot adapt to current complex traffic conditions and has low accuracy. In recent years, some researchers begin to excavate the real lane changing intention of the manually driven vehicle using novel processing methods, such as Bayesian networks, decision trees, random forests, or the like, the accuracy is relatively high, and consideration is more comprehensive.

The research on the identification of the lane changing behavior intention of the vehicle in recent years is mainly realized using real vehicle trajectory data and a machine learning method.

As shown in FIG. 1, in solution 1 in a prior art, a driving intention identification and vehicle trajectory prediction model based on a long-short term memory (LSTM) network is designed. An intention identification module and a trajectory output module are constructed; a target vehicle (a small vehicle) and surrounding vehicles are taken as a whole, and interactive information is considered; position and speed information of the vehicle is input as features; the model is trained and tested using an NGSIM data set; distribution of probabilities of the vehicle changing the lane to the left, traveling straightly and changing the lane to the right is calculated; model performance analysis is performed using a root mean square error.

As shown in FIG. 2, in solution 2 in the prior art, subsequent behavior identification and predictability verification are performed using NGSIM natural driving data. Local weighted smoothing and extraction processing is performed on the original data; vehicle behaviors are identified using a double-layer continuous hidden Markov model-Bayesian generation classifier (CHMM-BGC) and a bidirectional long-short term memory network (Bi-LSTM); meanwhile, an interaction between an adjacent front vehicle and surrounding vehicles is considered, such that the model has predictability, and the lane changing intention of a driver can be predicted before a lane changing time of the vehicle.

The above prior art has the following disadvantages.

(1) In the prior art, the lane changing behavior of the small vehicle is mainly studied without considering a moving bottleneck environment. A large vehicle on an expressway may generate a moving bottleneck when traveling at a low speed, and lack of research on the moving bottleneck may affect accuracy of the identification of the lane changing intention.

(2) The prior art generally overlooks research on different driving behavior features. Behavior habits of the driver and a vehicle performance may lead to large differences in driving behavior features, which can significantly affect a decision and execution of a lane change.

SUMMARY OF THE DISCLOSURE

In view of this, an object of the present application is to provide a method and system for identifying a lane changing intention of a manually driven vehicle, which can pertinently solve existing problems.

A method for identifying a lane changing intention of a manually driven vehicle, comprising:

preprocessing a preset vehicle trajectory data set, wherein specific steps are as follows: performing data cleaning on vehicle traveling data, removing weight, unifying time granularity to be 0.1 s, and processing missing data; determining vehicles around a vehicle using horizontal and vertical coordinates and a timestamp of vehicle traveling; for an edge lane, virtually constructing a lane to fill the vehicle data; expanding and equalizing sample data adopting a sliding time window method; and converting a format of the vehicle traveling data into a preset format;

extracting vehicle traveling features and driving behavior features of the target vehicle, wherein specific steps are as follows: acquiring the vehicle traveling features of the target vehicle when a small vehicle and a large vehicle are followed; performing K-means++ cluster analysis on the target vehicle according to six features of an average speed, a maximum speed, a lane changing frequency, a speed change, a vehicle head distance and a vehicle head time interval, so as to obtain the driving behavior features of the target vehicle;

constructing a vehicle following and lane changing decision prediction model based on machine learning, and inputting the preprocessed vehicle trajectory data set into the prediction model for training, which comprises: fusing the preprocessed vehicle trajectory data sets as data input of the model; extracting vehicle operation parameters, i.e., a speed, an acceleration and a vehicle head distance; performing assignment on data indicating that the target vehicle and the surrounding vehicles comprise a large vehicle to obtain a large vehicle feature value; extracting a clustering feature value formed by k-means++ clustering; filling parameters of a vehicle vacancy in the surrounding vehicles; and taking the speed, the acceleration, the vehicle head distance, the large vehicle feature value and the clustering feature value as feature indexes of the prediction model, inputting the feature indexes in a vector form, and performing prediction judgment on the vehicle following and lane changing intention decision;

obtaining the speed, the acceleration and the vehicle head distance of the target vehicle according to the vehicle traveling features of the target vehicle, and obtaining the large vehicle feature value and the clustering feature value according to the driving behavior features of the target vehicle; and inputting the speed, the acceleration, the vehicle head distance, the large vehicle feature value and the clustering feature value of the target vehicle into the trained prediction model to obtain a lane changing intention identification result of the target vehicle.

The present application has the following advantages and user experiences.

(1) In the present invention, the lane changing intention of the manually driven vehicle can be identified in an expressway bottleneck environment, thereby facilitating a reduction of a collision risk and improving a driving safety degree.

(2) The present invention can reduce congestion and traffic accidents caused by wrong lane changing decisions, and guarantee stable operation of a road, thereby improving service quality of an expressway.

(3) In the present invention, an actual lane changing situation of the manually driven vehicle can be reflected, and reference value is provided for assistance in an intelligent vehicle driving decision system.

BRIEF DESCRIPTION OF DRAWINGS

FIG. 4 shows a schematic diagram of unification of data units in the embodiment of the present application.

FIG. 7 is a schematic diagram of analysis of driving types in the present embodiment.

FIG. 8 is a schematic diagram of a target vehicle and surrounding vehicles in the embodiment of the present application.

DETAILED DESCRIPTION OF PREFERRED EMBODIMENTS

Figure 1:
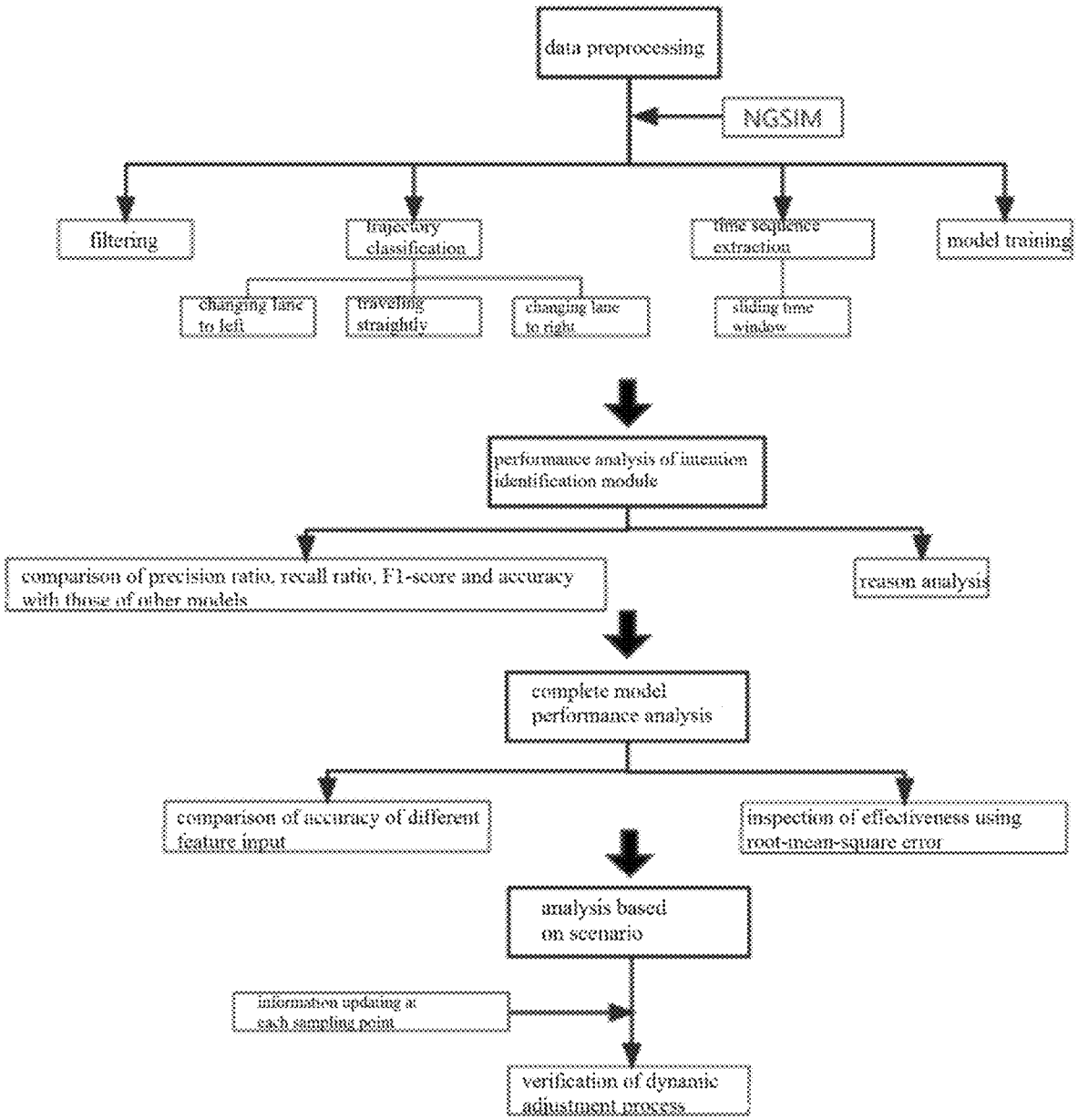
FIG. 1 shows a schematic principle diagram of an architecture of a first prior art.
Figure 2:
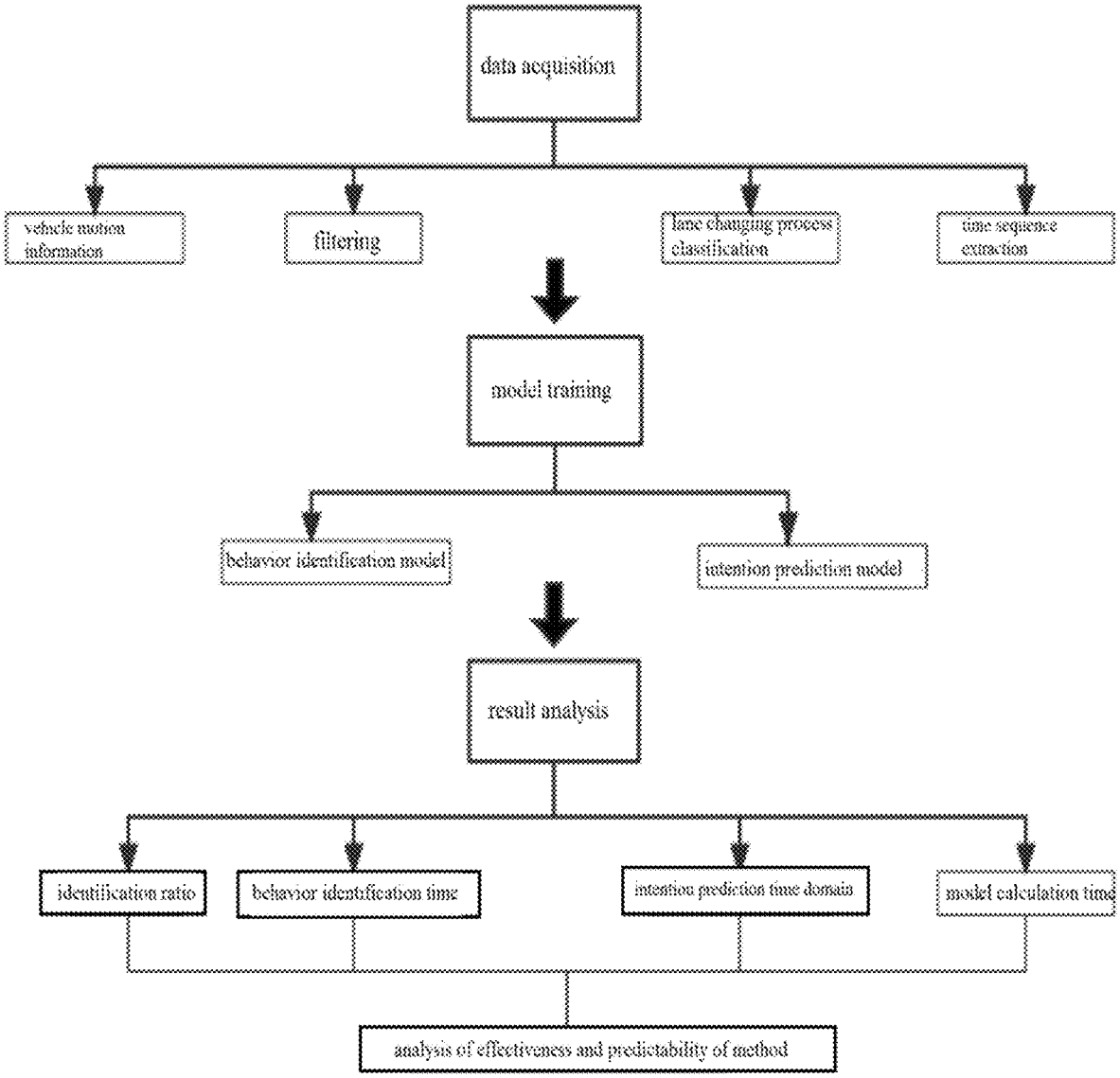
FIG. 2 shows a schematic principle diagram of an architecture of a second prior art.

The present application will be described in further detail with reference to the drawings and embodiments.

In the present invention, a traveling trajectory of a vehicle and driving behavior features of surrounding vehicles in following and lane changing traveling processes are analyzed utilizing microscopic vehicle trajectory data, and a model is trained using an artificial intelligent algorithm to realize identification of a lane changing intention of the vehicle.

The present invention provides a method for identifying a lane changing intention of a vehicle in a moving bottleneck scenario, in which a feature value is additionally set for a large vehicle, identification of the lane changing intention in the presence of the large vehicle is mainly considered, and accuracy of the identification of the lane changing intention in the moving bottleneck scenario may be improved.

In the present invention, the method for identifying a lane changing intention of a vehicle with driving behavior feature classification is used, an average speed, a maximum acceleration, a lane changing frequency, or the like, are taken as features, cluster analysis is carried out on the vehicle using K-means++, a clustering result is taken as feature input of a lane changing intention identification model, and a more accurate identification result can be obtained.

A vehicle trajectory data set relied on by the present invention includes an NGSIM data set and a HighD data set, content is detailed, and starting frame numbers, timestamps, vehicle numbers, horizontal and vertical coordinates, global coordinates, vehicle lengths, vehicle widths, vehicle types, traveling directions, movement behaviors, or the like, of different vehicles within a certain time period are recorded. The following table shows main parameters of the vehicle trajectory data set in the present application.

| | |
|---|---|
| Vehicle_Id | Vehicle number (ascending order according to time of entry into region) |
| Frame_Id | Frame of data at a certain time (ascending order according to start time), frame number of same vehicle number being not repeated |
| Total_Frame | Total frame number of vehicle in data set |
| Global_Time | Timestamp (ms) |
| Local_X | Horizontal (X) coordinate of center of front of vehicle |
| Local_Y | Vertical (Y) coordinate of center of front of vehicle |
| v_length | Vehicle length |
| v_Width | Vehicle width |
| v_Class | Vehicle type: 1-motorcycle, 2-automobile, 3-large vehicle |
| Lane_ID | Current lane position of vehicle |
| Preceding | Vehicle number of preceding vehicle in same lane, value "0" indicating that there is no preceding vehicle-occurring at end of researched section and ramp leaving |
| Following | Number of rear vehicle following target vehicle in same lane, value "0" indicating that there is no following vehicle-occurring at beginning of researched section and ramp |

By analyzing and processing the original data set, in order to enable the model to effectively predict the lane changing intention of the vehicle, the following feature input is extracted.

Speed obtained by dividing a traveling distance of the vehicle in a certain period of time by the used time:

$$V = \frac{\text{Local_y}_{t+\Delta t} - \text{Local_y}_t}{\Delta t}$$

wherein V is an instantaneous speed of the vehicle, t is a time, $\text{Local_y}_{t+\Delta t}$ and $\text{Local_y}_t$ are vertical coordinates of the vehicle at different times, and the difference represents a distance traveled in unit time Δt.

Acceleration $$A = \frac{V_{t+\Delta t} - V_t}{\Delta t}$$

wherein A represents an instantaneous acceleration of the vehicle, t is a time, $V_{t+\Delta t}$ and $V_t$ are instantaneous speeds of the vehicle at different times, and the difference represents a speed change quantity in unit time Δt.

Vehicle head distance which is a vertical displacement coordinate difference at the same time:

$$S_{mn} = |\text{Local_y}_n - \text{Local_y}_m|$$

wherein m refers to the target vehicle, n refers to a vehicle around the target vehicle, $S_{mn}$ denotes a vehicle head distance between the mth vehicle and the nth surrounding vehicle, n has a value range of [1, 6], $\text{Local_y}_m$ represents a vertical coordinate of the mth vehicle, and $\text{Local_y}_n$ denotes a vertical coordinate of the nth vehicle around the mth vehicle.

Large vehicle feature value obtained by the vehicle type in the vehicle trajectory data set:

$$M = \begin{cases} 0, \text{ target vehicle is small vehicle} \\ 1, \text{ target vehicle is large vehicle} \end{cases}$$

Data for indicating whether the vehicles around the target vehicle include a large vehicle is marked with a 0-1 variable as a part of data input.

Clustering feature value $$N = \begin{cases} 0, \text{ first type (effective and rash)} \\ 1, \text{ second type (effective and experiential)} \\ 2, \text{ third type (safe and careful)} \\ 3, \text{ fourth type (safe and robust)} \end{cases}$$

The driving behavior features are subjected to cluster analysis with a K-means++ method according to six features of an average speed, a maximum speed, a lane changing frequency, a speed change, the vehicle head distance and a vehicle head time interval, and the researched vehicles are determined to be divided into four classes according to an elbow rule, which serve as feature input parts of data.

The above features are input into the vehicle intention identification model in a form of a vector of [−1, 40, 28].

A relationship of the vehicle lane changing intention to different features may be embodied by the following expression:

$$Y = f(V_m^t, V_n^t, A_m^t, A_n^t, S_{mn}^t, M, N)$$

wherein Y is the lane changing intention of the target vehicle, t indicates a time, $V_m^t$, and $V_n^t$ are speeds of the target vehicle m and the surrounding nth vehicle at the time t, $A_m^t$ and $A_n^t$ are accelerations of the target vehicle m and the surrounding nth vehicle at the time t, and $S_{mn}^t$ represents the vehicle head distance between the mth vehicle and the surrounding nth vehicle at the time t.

Figure 3:
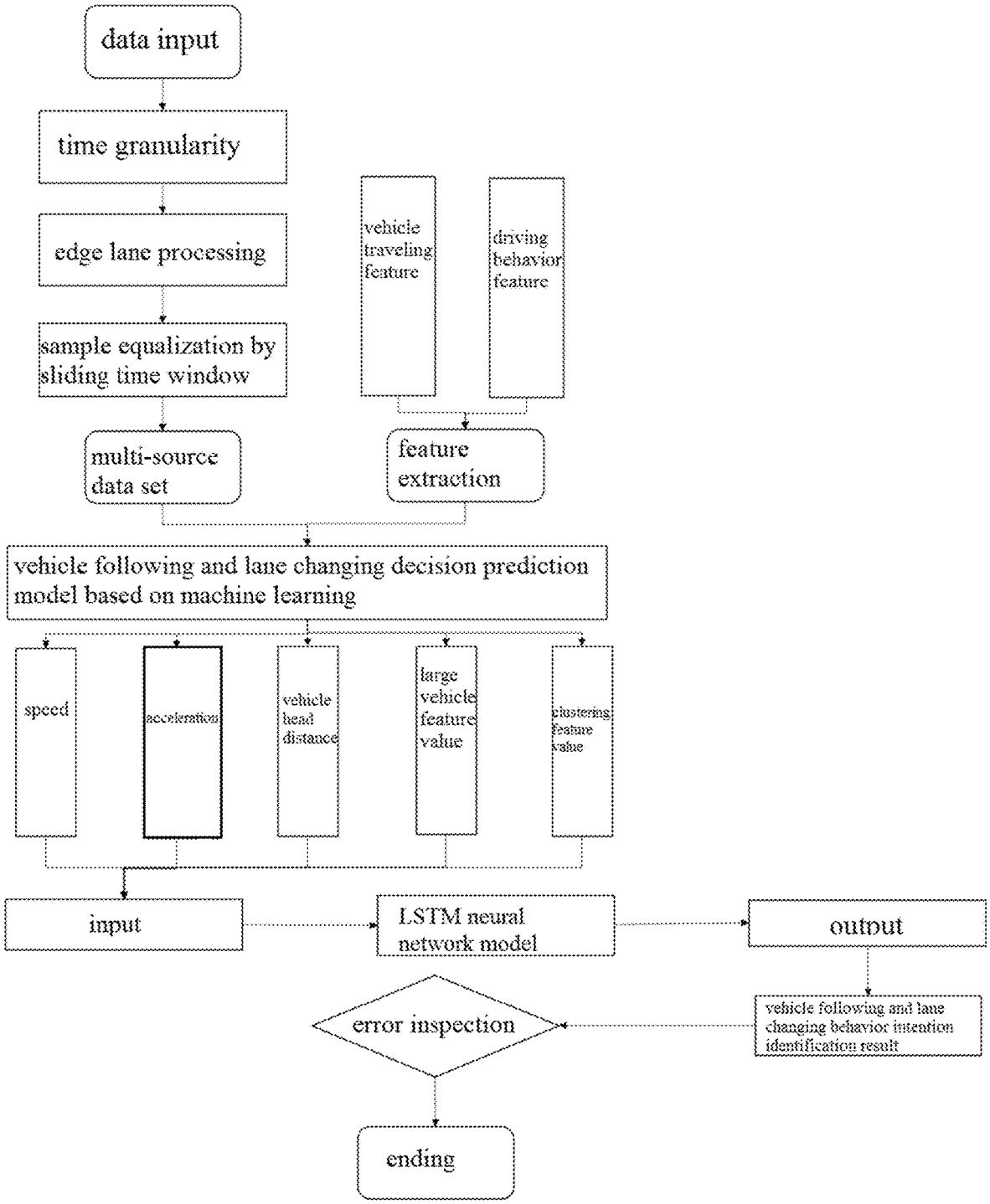
FIG. 3 shows a flow chart of a method for identifying a lane changing intention of a manually driven vehicle according to an embodiment of the present application.

An overall flow framework of the present invention is shown in FIG. 3, and specific flow analysis is as follows.

(1) Preprocessing the data: data preprocessing means that the data sets, such as NGSIM, HighD, or the like, are uniformly processed, such that the processed data can be easily read by a machine.

The data preprocessing process includes the following specific steps:

a. performing data cleaning on vehicle traveling data, removing weight, unifying time granularity to be 0.1 s, and processing missing data;

b. determining the vehicles around the target vehicle using the horizontal and vertical coordinates and the timestamp of vehicle traveling;

c. for an edge lane, virtually constructing a lane to fill the vehicle data;

d. expanding and equalizing sample data adopting a sliding time window method; and e. converting a format of the vehicle traveling data into a format convenient to process.

The NGSIM data set is derived from American expressway driving data, and the HighD data set is derived from Germany expressway driving data.

(2) Extracting vehicle traveling features and the driving behavior features of the target vehicle: the feature extraction means that feature input is provided for the vehicle following and lane changing decision prediction model by researching a relationship among the following different vehicle types, different traffic states, operation parameters and the vehicle head distance of the vehicle.

The feature extraction process includes the following specific steps:

a. researching the vehicle traveling features of the target vehicle under two different conditions of following a small vehicle and a large vehicle, and finding that following of different vehicle types influences the vehicle head distance between the target vehicle and the preceding vehicle; and b. performing K-means++ cluster analysis on the vehicle according to the six features of the average speed, the maximum speed, the lane changing frequency, the speed change, the vehicle head distance and the vehicle head time interval, so as to obtain the driving behavior features of the target vehicle, the driving behavior features also influencing the lane changing decision. The vehicles are determined to be classified into four classes according to the elbow rule: an "effective and rash" type, an "effective and experiential" type, a "safe and careful" type, and a "safe and robust" type.

(3) Constructing a vehicle following and lane changing decision prediction model based on machine learning, and inputting the preprocessed vehicle trajectory data set into the prediction model for training.

Firstly, a double-layer long-short term memory (LSTM) neural network model is built by fusing multivariate data sets, such as NGSIM, HighD, or the like. The training process is as follows:

a. fusing the data sets, such as NGSIM, HighD, or the like, as data input of the model;

b. extracting the vehicle operation parameters, i.e., the speed, the acceleration and the vehicle head distance;

c. performing assignment on the data indicating that the target vehicle and the surrounding vehicles include a large vehicle to obtain the large vehicle feature value;

d. extracting the clustering feature value formed by k-means++ clustering;

e. filling parameters of a vehicle vacancy in the surrounding vehicles; and f. taking the obtained indexes as feature indexes of the long-short term memory neural network model, inputting the feature indexes in a vector form, and performing prediction judgment on the vehicle following and lane changing intention decision (a left turn, following and a right turn).

(4) Obtaining the speed, the acceleration and the vehicle head distance of the target vehicle according to the vehicle traveling features of the target vehicle, and obtaining the large vehicle feature value and the clustering feature value according to the driving behavior features of the target vehicle; and inputting the speed, the acceleration, the vehicle head distance, the large vehicle feature value and the clustering feature value of the target vehicle into the trained prediction model to obtain a lane changing intention identification result of the target vehicle.

(5) Evaluating the model: the researched vehicle is classified into two types according to whether a large vehicle exists around the researched vehicle, and model evaluation is performed on indexes, such as use accuracy, precision, a recall ratio, an F1-score, a G-mean, or the like.

First Embodiment

Figures 5, 6:
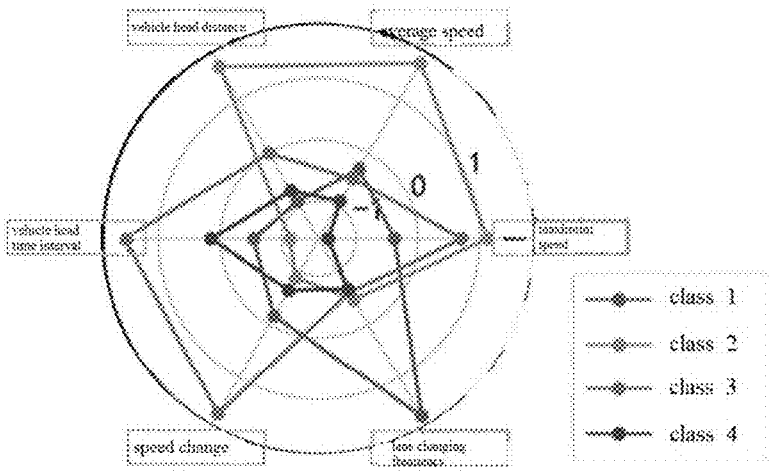
FIG. 5 shows a view of an example of vehicle data specifically applied in the embodiment of the present application.
FIG. 6 shows a radar chart of cluster analysis in the present embodiment.

Example of data preprocessing (1) Performing data cleaning on multi-source data sets, and improving vehicle data information to facilitate subsequent data processing. As shown in FIG. 4, data units are unified. FIG. 5 is a view of an example of vehicle data specifically applied in the present application.

(2) Performing preliminary analysis according to vehicle traveling features, clustering plural pieces of data of the vehicle, and analyzing a vehicle traveling capacity. FIG. 6 shows a radar chart of cluster analysis in the present embodiment, and FIG. 7 is a schematic diagram of analysis of driving types.

(3) Determining vehicles around the target vehicle according to geographic coordinates and a timestamp of the traveling vehicle. FIG. 8 shows a schematic diagram of the target vehicle and the surrounding vehicles.

Figure 9:
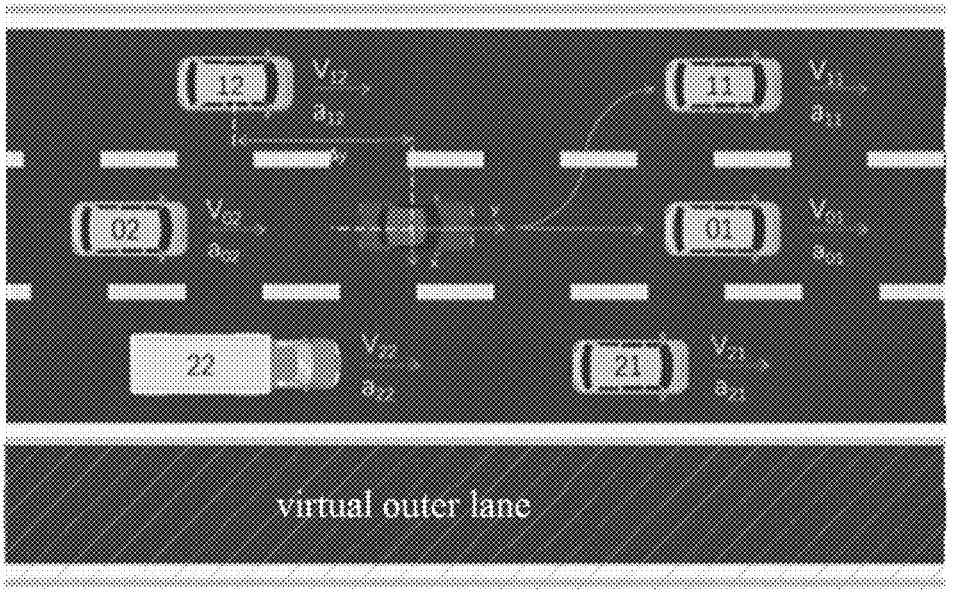
FIG. 9 is a schematic diagram of virtual lane construction in the embodiment of the present application.

(4) For an edge lane, independently constructing a virtual lane, and further filling data of the target vehicle and the surrounding vehicles. FIG. 9 shows a schematic diagram of virtual lane construction.

Figure 10:
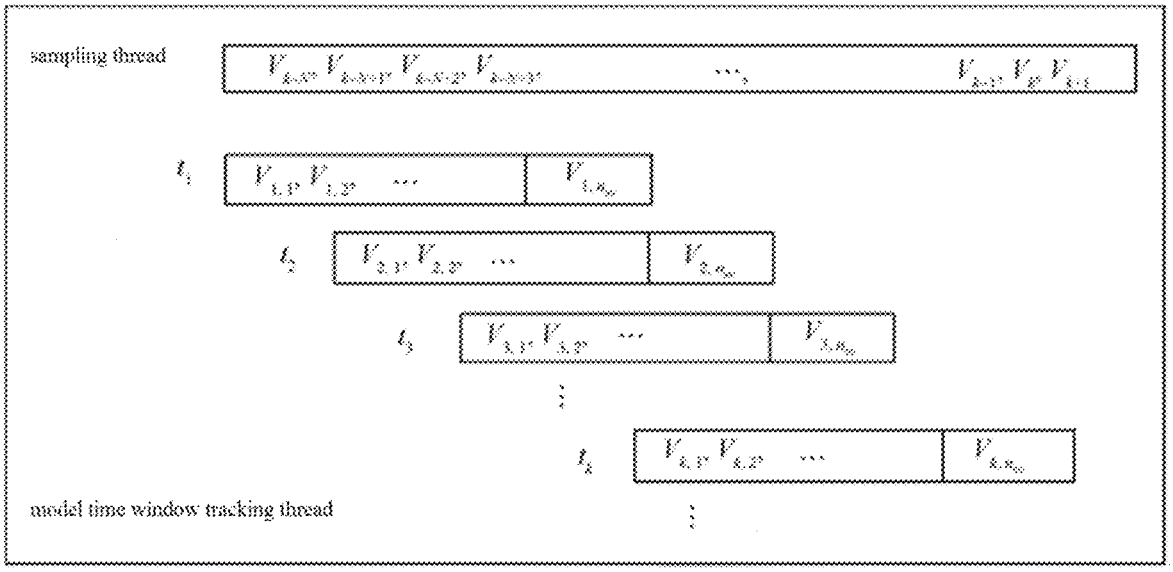
FIG. 10 is a schematic diagram of a sliding time window strategy in the embodiment of the present application.

(5) Expanding and equalizing samples by adopting a sliding time window method and taking a point where a position of the vehicle changes as a lane changing point. FIG. 10 shows a schematic diagram of a sliding time window strategy.

$$V=(V_{1,1}+V_{1,2}+\ldots+V_{1,n_{sv}})+(V_{2,1}+V_{2,2}+\ldots+V_{2,n_{sv}})+\ldots+(V_{k,1}+V_{k,2}+\ldots+V_{k,n_{sv}})$$

In FIG. 10, t is a sampling time, V is the sample, $n_{sv}$ is a time window width, and $V_{k,j}$ refers to the jth sample with a unit width at the sampling time $t_k$.

Figure 11:
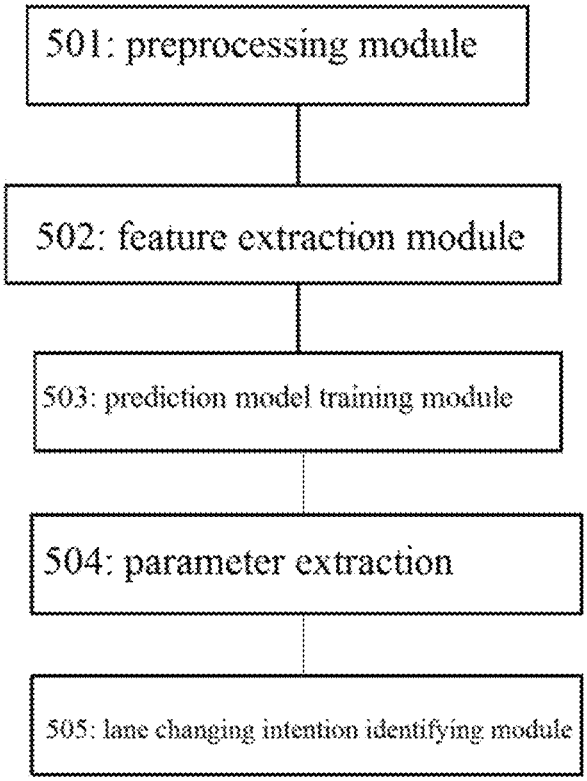
FIG. 11 shows a configuration view of a system for identifying a lane changing intention of a manually driven vehicle according to an embodiment of the present application.

An embodiment of the application provides a system for identifying a lane changing intention of a manually driven vehicle, which is configured to execute the method for identifying a lane changing intention of a manually driven vehicle according to the above embodiment, and as shown in FIG. 11, the system includes:

a preprocessing module 501 configured to preprocessing a preset vehicle trajectory data set;

a feature extraction module 502 configured to extract vehicle traveling features and driving behavior features of a target vehicle;

a prediction model training module 503 configured to construct a vehicle following and lane changing decision prediction model based on machine learning, and input the preprocessed vehicle trajectory data set into the prediction model for training;

a parameter extraction module 504 configured to obtain a speed, an acceleration and a vehicle head distance of the target vehicle according to the vehicle traveling features of the target vehicle, and obtain a large vehicle feature value and a clustering feature value according to the driving behavior features of the target vehicle; and a lane changing intention identifying module 505 configured to input the speed, the acceleration, the vehicle head distance, the large vehicle feature value and the clustering feature value of the target vehicle into the trained prediction model to obtain a lane changing intention identification result of the target vehicle.

The system for identifying a lane changing intention of a manually driven vehicle according to the embodiment of the present application has a same inventive concept as the method for identifying a lane changing intention of a manually driven vehicle according to the embodiment of the present application, and has same beneficial effects as the method adopted, operated or implemented by an application program stored by the system.

An embodiment of the present application further provides an electronic device corresponding to the method for identifying a lane changing intention of a manually driven vehicle according to the foregoing embodiment, so as to execute the method for identifying a lane changing intention of a manually driven vehicle. The embodiments of the present application are not limited.

Figure 12:
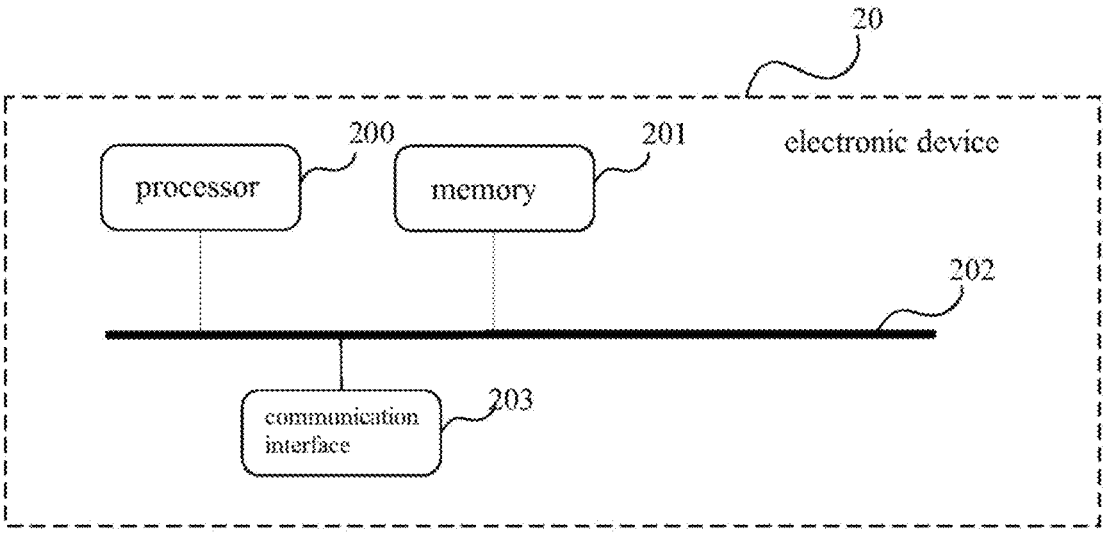
FIG. 12 shows a schematic structural diagram of an electronic device according to an embodiment of the present application.

FIG. 12 shows a schematic diagram of the electronic device according to some embodiments of the present application. As shown in FIG. 12, the electronic device 20 includes: a processor 200, a memory 201, a bus 202 and a communication interface 203, wherein the processor 200, the communication interface 203 and the memory 201 are connected by the bus 202; the memory 201 stores a computer program executable on the processor 200, and the processor 200 executes the method for identifying a lane changing intention of a manually driven vehicle according to any of the foregoing embodiments of the present application when executing the computer program.

The memory 201 may include a random access memory (RAM) or a non-volatile memory, such as at least one disk memory. A communication connection between a network element of the system and at least one other network element is realized by at least one communication interface 203 (which may be wired or wireless), and the Internet, a wide area network, a local network, a metropolitan area network, or the like, may be used.

The bus 202 may be an ISA bus, a PCI bus, an EISA bus, or the like. The bus may be classified into an address bus, a data bus, a control bus, or the like. The memory 201 is configured to store a program, the processor 200 executes the program after receiving an execution instruction, and the method for identifying a lane changing intention of a manually driven vehicle according to any of the embodiments of the present application can be applied to the processor 200, or can be implemented by the processor 200.

The processor 200 may be an integrated circuit chip having a signal processing capability. During implementation, the steps of the above method may be performed by integrated logic circuits of hardware or instructions in a form of software in the processor 200. The processor 200 may be a general-purpose processor, including a central processing unit (CPU), a network processor (NP), or the like; or a digital signal processor (DSP), an application specific integrated circuit (ASIC), a field programmable gate array (FPGA) or other programmable logic devices, discrete gates or transistor logic devices, and discrete hardware components. The various methods, steps, and logic blocks in the embodiments of the present application may be implemented or performed. The general-purpose processor may be a microprocessor or any conventional processor, or the like. The steps of the method according to the embodiment of the present application may be directly implemented by a hardware decoding processor, or implemented by a combination of hardware and software modules in the decoding processor. The software module may be located in a storage medium well known in the art, such as an RAM, a flash memory, a read only memory, a programmable read only memory, an electrically erasable programmable memory, a register, or the like. The storage medium is located in the memory 201, and the processor 200 reads information in the memory 201 and completes the steps of the method in conjunction with the hardware thereof.

The electronic device according to the embodiment of the present application has a same inventive concept as the method for identifying a lane changing intention of a manually driven vehicle according to the embodiment of the present application, and has same beneficial effects as the method adopted, operated or implemented by the electronic device.

Figure 13:
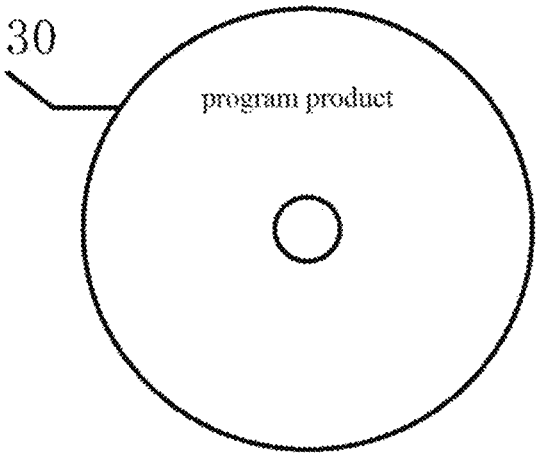
FIG. 13 shows a schematic diagram of a storage medium according to an embodiment of the present application.

An embodiment of the present application further provides a computer-readable storage medium corresponding to the method for identifying a lane changing intention of a manually driven vehicle according to the foregoing embodiment; the computer-readable storage medium shown in FIG. 13 is an optical disc 30 having a computer program (i.e., a program product) stored thereon, and when executed by the processor, the computer program executes the method for identifying a lane changing intention of a manually driven vehicle according to any of the foregoing embodiments.

It should be noted that examples of the computer-readable storage medium may also include, but are not limited to, a phase change random access memory (PRAM), a static random access memory (SRAM), a dynamic random access memory (DRAM), other types of random access memories (RAMs), a read only memory (ROM), an electrically erasable programmable read only memory (EEPROM), a flash memory, or other optical and magnetic storage media, which are not repeated herein.

The computer-readable storage medium according to the embodiment of the present application has a same inventive concept as the method for identifying a lane changing intention of a manually driven vehicle according to the embodiment of the present application, and has same beneficial effects as the method adopted, operated or implemented by an application program stored by the storage medium.

What is claimed is:

1. A method for identifying a lane changing intention of a manually driven vehicle, comprising:

preprocessing a preset vehicle trajectory data set, wherein specific steps are as follows: performing data cleaning on vehicle traveling data, removing weight, unifying time granularity to be 0.1 s, and processing missing data; determining vehicles around a vehicle using horizontal and vertical coordinates and a timestamp of vehicle traveling; for an edge lane, virtually constructing a lane to fill the vehicle data; expanding and equalizing sample data adopting a sliding time window method; and converting a format of the vehicle traveling data into a preset format;

extracting vehicle traveling features and driving behavior features of the target vehicle, wherein specific steps are as follows: acquiring the vehicle traveling features of the target vehicle when a small vehicle and a large vehicle are followed; performing K-means++ cluster analysis on the target vehicle according to six features of an average speed, a maximum speed, a lane changing frequency, a speed change, a vehicle head distance and a vehicle head time interval, so as to obtain the driving behavior features of the target vehicle;

constructing a vehicle following and lane changing decision prediction model based on machine learning, and inputting the preprocessed vehicle trajectory data set into the prediction model for training, which comprises: fusing the preprocessed vehicle trajectory data sets as data input of the model; extracting vehicle operation parameters, i.e., a speed, an acceleration and a vehicle head distance; performing assignment on data indicating that the target vehicle and the surrounding vehicles comprise a large vehicle to obtain a large vehicle feature value; extracting a clustering feature value formed by k-means++ clustering; filling parameters of a vehicle vacancy in the surrounding vehicles; and taking the speed, the acceleration, the vehicle head distance, the large vehicle feature value and the clustering feature value as feature indexes of the prediction model, inputting the feature indexes in a vector form, and performing prediction judgment on the vehicle following and lane changing intention decision;

obtaining the speed, the acceleration and the vehicle head distance of the target vehicle according to the vehicle traveling features of the target vehicle, and obtaining the large vehicle feature value and the clustering feature value according to the driving behavior features of the target vehicle; and inputting the speed, the acceleration, the vehicle head distance, the large vehicle feature value and the clustering feature value of the target vehicle into the trained prediction model to obtain a lane changing intention identification result of the target vehicle.

2. The method according to claim 1, wherein the preset vehicle trajectory data set comprises an NGSIM data set and a HighD data set.

3. The method according to claim 1, wherein the driving behavior feature comprises one of an effective and rash type, an effective and experiential type, a safe and careful type and a safe and robust type.

4. The method according to claim 1, wherein the vehicle following and lane changing decision prediction model based on machine learning is an LSTM neural network model.

5. A system for identifying a lane changing intention of a manually driven vehicle, comprising:

a preprocessing module configured to preprocess a preset vehicle trajectory data set, wherein the preprocessing comprises: performing data cleaning on vehicle traveling data, removing weight, unifying time granularity to be 0.1 s, and processing missing data; determining vehicles around a vehicle using horizontal and vertical coordinates and a timestamp of vehicle traveling; for an edge lane, virtually constructing a lane to fill the vehicle data; expanding and equalizing sample data adopting a sliding time window method; and converting a format of the vehicle traveling data into a preset format;

a feature extraction module configured to extract vehicle traveling features and driving behavior features of the target vehicle, wherein specific steps are as follows: acquiring the vehicle traveling features of the target vehicle when a small vehicle and a large vehicle are followed; performing K-means++ cluster analysis on the target vehicle according to six features of an average speed, a maximum speed, a lane changing frequency, a speed change, a vehicle head distance and a vehicle head time interval, so as to obtain the driving behavior features of the target vehicle;

a prediction model training module configured to construct a vehicle following and lane changing decision prediction model based on machine learning, and inputting the preprocessed vehicle trajectory data set into the prediction model for training, wherein the process comprises: fusing the preprocessed vehicle trajectory data sets as data input of the model; extracting vehicle operation parameters, i.e., a speed, an acceleration and a vehicle head distance; performing assignment on data indicating that the target vehicle and the surrounding vehicles comprise a large vehicle to obtain a large vehicle feature value; extracting a clustering feature value formed by k-means++ clustering; filling parameters of a vehicle vacancy in the surrounding vehicles; and taking the speed, the acceleration, the vehicle head distance, the large vehicle feature value and the clustering feature value as feature indexes of the prediction model, inputting the feature indexes in a vector form, and performing prediction judgment on the vehicle following and lane changing intention decision;

a parameter extraction module configured to obtain a speed, an acceleration and a vehicle head distance of the target vehicle according to the vehicle traveling features of the target vehicle, and obtain a large vehicle feature value and a clustering feature value according to the driving behavior features of the target vehicle; and a lane changing intention identifying module configured to input the speed, the acceleration, the vehicle head distance, the large vehicle feature value and the clustering feature value of the target vehicle into the trained prediction model to obtain a lane changing intention identification result of the target vehicle.

6. An electronic device, comprising a memory, a processor and a computer program stored on the memory and executable on the processor, wherein the processor executes the computer program to implement the method according to claim 1.

7. A computer-readable storage medium having a computer program stored thereon, wherein the program is executed by a processor to implement the method according to claim 1.

* * * * *